US009651056B2

(12) United States Patent
Ikeda et al.

(10) Patent No.: US 9,651,056 B2
(45) **Date of Patent: *May 16, 2017**

(54) TURBO FAN AND AIR CONDITIONING APPARATUS

(71) Applicant: MITSUBISHI ELECTRIC CORPORATION, Chiyoda-ku (JP)

(72) Inventors: Takashi Ikeda, Tokyo (JP); Takahide Tadokoro, Tokyo (JP); Masahiko Takagi, Tokyo (JP); Makoto Kurihara, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 379 days.

This patent is subject to a terminal disclaimer.

(21) Appl. No.: 14/454,201

(22) Filed: Aug. 7, 2014

(65) Prior Publication Data

US 2015/0030454 A1 Jan. 29, 2015

Related U.S. Application Data

(62) Division of application No. 13/319,804, filed as application No. PCT/JP2010/001874 on Mar. 16, 2010, now Pat. No. 8,834,121.

(30) Foreign Application Priority Data

Jun. 11, 2009 (JP) ..... 2009-139986

(51) Int. Cl.
*F04D 17/00* (2006.01)
*F04D 29/28* (2006.01)
(Continued)

(52) U.S. Cl.
CPC ..... *F04D 29/281* (2013.01); *F04D 25/088* (2013.01); *F04D 29/242* (2013.01);
(Continued)

(58) Field of Classification Search
CPC ..... F04D 17/10; F04D 29/24; F04D 29/242; F04D 29/245; F04D 29/281; F04D 29/30;
(Continued)

(56) References Cited

U.S. PATENT DOCUMENTS 3,668,887 A 6/1972 Riello
4,231,706 A 11/1980 Ueda et al.
(Continued)

FOREIGN PATENT DOCUMENTS

JP 5-312191 A 11/1993
JP 2730395 62 3/1998
(Continued)

OTHER PUBLICATIONS

First Office Action issued Aug. 3, 2016 by the Chinese Patent Office in corresponding Chinese Patent Application No. 2015101445331, and an English translation of the text portion thereof.
(Continued)

*Primary Examiner* — Ninh H Nguyen
(74) *Attorney, Agent, or Firm* — Buchanan Ingersoll & Rooney PC

(57) ABSTRACT

A turbo fan blade front edge has, between a main-plate-side blade front edge and a shroud-side blade front edge, a projecting blade front edge that distances from a blade rear edge (located in a rotation direction A) as it becomes further away from a main plate, which curves to a position away from a rotation center. In a range close to the main plate, a main-plate-side front-edge skirt portion distances from the blade rear edge and inclines away from the rotation center as it becomes closer to the main plate. A main-plate-side blade
(Continued)

rear edge, close to the main plate of the blade rear edge, is substantially perpendicular to the main plate and a shroud-side blade rear edge, close to a shroud, is inclined so as to gradually distance away from the blade front edge (behind in the rotation direction A) as it becomes further away from the main plate.

9 Claims, 13 Drawing Sheets

(51) Int. Cl.

| | |
|---|---|
| ***F04D 29/24*** | (2006.01) |
| ***F04D 25/08*** | (2006.01) |
| ***F04D 29/30*** | (2006.01) |
| ***F04D 29/66*** | (2006.01) |

(52) U.S. Cl.
CPC ..... *F04D 29/245* (2013.01); *F04D 29/282* (2013.01); *F04D 29/30* (2013.01); *F04D 29/667* (2013.01); *F05D 2240/303* (2013.01); *F05D 2240/304* (2013.01)

(58) Field of Classification Search
CPC ..... F04D 29/667; F05D 2240/303; F05D 2240/304
See application file for complete search history.

(56) References Cited

U.S. PATENT DOCUMENTS 5,478,201 A 12/1995 Amr
6,042,335 A 3/2000 Amr
6,338,610 B1 * 1/2002 Harada ..... F04D 29/2255 416/186 R
6,558,120 B2 * 5/2003 Kim ..... F04D 25/12 416/186 R
6,769,876 B2 * 8/2004 Sakai ..... F01D 1/02 415/206
8,834,121 B2 * 9/2014 Ikeda ..... F04D 25/088 416/186 R

FOREIGN PATENT DOCUMENTS

JP 2730396 B2 3/1998
JP 3092554 B2 9/2000
JP 2006-002689 A 1/2006
JP 3861008 B2 12/2006
JP 2007-205269 A 8/2007
JP 2008-002379 A 1/2008

OTHER PUBLICATIONS

Extended European Search Report issued Aug. 10, 2015 by the European Patent Office in corresponding European Patent Application No. 10785873.0 (8 pages).
International Search Report (PCT/ISA/210) issued on Jun. 1, 2010, by Japanese Patent Office as the International Searching Authority for International Application No. PCT/JP2010/001874.
Office Action issued by the Chinese Patent Office on Nov. 5, 2013, in corresponding Chinese Patent Application No. 201080025499.1 and an English translation of the Official Action. (8 pages).
Japanese Office Action (Notification of Reasons for Refusal) dated May 8, 2012, issued in corresponding Japanese Patent Application No. 2009-139986 (4 pages).
Communication Pursuant to Article 94(3) EPC issued Dec. 13, 2016 by the European Patent Office in corresponding European Patent Application No. 10 785 873.0.

* cited by examiner

TURBO FAN AND AIR CONDITIONING APPARATUS

TECHNICAL FIELD

The present invention relates to a turbo fan and an air conditioning apparatus and particularly to a turbo fan used in an air conditioning apparatus that performs air cleaning, humidification/dehumidification, cooling/heating and the like and an air conditioning apparatus using the turbo fan.

BACKGROUND ART

Hitherto, as a blower fan mounted on a ceiling-concealed type air conditioning apparatus, a turbo fan in which a blade of a fan is formed in a three-dimensional shape has been widely employed. For example, a blade is disclosed in which the position of a joint end on a side plate side from a front edge to a rear edge is shifted to a rotation direction A with respect to a joint end with a main plate (a virtual line that connects the front edge and the rear edge is inclined with respect to a radial line), and a shroud end on the front edge side of the blade is inclined to the rotation direction A side (see patent Literature 1, for example).

By forming the turbo fan as above, an end portion on the shroud side on the blade front-edge side where an axial velocity component in inflow air becomes particularly large is inclined to the rotation direction A side and follows an inflow direction of the inflowing air, separation of air which may easily occur in a counter-rotation direction can be prevented and improvement in performance and noise reduction can be realized.

Also, a turbo fan is disclosed, for example, in which a first tangent line tangent to the rear edge at a connection position (first connection position) between the main plate and a rear edge portion of a blade extends so as to become close to the shroud in the rotation direction A side of the blade and a second tangent line tangent to the rear edge at a connection position (second connection position) between the side plate and the blade extends so as to become close to the main plate in the rotation direction A side of the blade (see Patent Literature 2, for example).

By forming the turbo fan as above, a turbulent noise caused by an air-flow velocity difference at an impeller outlet can be reduced.

Moreover, for example, a turbo fan with a serrated rear edge portion of the blade is disclosed (see Patent Literature 3, for example).

By forming the turbo fan as above, compared to those with a straight rear edge portion, pressure gradient and velocity loss of an air flow by merging of flows at the rear end portion becomes smaller, and the turbulent flow is suppressed thus achieving reduction of noise.

CITATION LIST

Patent Literature

Patent Literature 1: Japanese Patent No. 3861008 (pages 7 to 8, FIG. 5)

Patent Literature 2: Japanese Unexamined Patent Application Publication No. 2007-205269 (pages 5 to 6, FIG. 7)

Patent Literature 3: Japanese Patent No. 3092554 (pages 4 to 5, FIG. 1)

SUMMARY OF INVENTION

Technical Problem

However, a conventional turbo fan and an air conditioning apparatus using the turbo fan have the following problems.

(i) The turbo fan disclosed in Patent Literature 1 is a blade that has the end of the joint on the side plate side the joint with the main plate from the front edge to the rear edge offset to the rotation direction A, and the blade's front edge on the shroud side inclined to the rotation direction A side. The blade thus agrees with the inflow direction of the inflowing air, preventing the separation of air that easily occurs on the shroud side of the blade's front edge and the face facing the counter-rotation direction.

However, since the entire blade is inclined to the rotation direction A, a suction flow flowing to the downstream side easily flows to the main plate side, and by separation of air in the vicinity of the rear edge portion on the blade side-plate side, turbulent flow or a low air-velocity region is generated, and air-velocity distribution may become uneven.

Also, since the face facing the blade's rotation direction A is joined to the main plate at an acute angle, the flow easily concentrates to this joint portion (corner portion) and blow-out air velocity on the main plate side may tend to increase.

Noise is therefore aggravated by turbulent flow and uneven air-velocity distribution.

Moreover, since in a horizontal section crossing the rotary shaft of the blade at a right angle, the thickness of the blade in an arbitrary radius around a rotation center O is the same in the height direction of the impeller, in the case of molding using a thermoplastic resin such as ABS or Ps as a material, the blade becomes solid and the weight thereof may increase.

(ii) In the turbo fan disclosed in Patent Literature 2, at a connection position (first connection position) between the main plate and the rear edge portion of the blade, the first tangent line tangent to the rear edge extends toward the rotation direction A of the blade so as to become close to the shroud and at a connection position (second connection position) between the side plate and the blade, the second tangent line tangent to the rear edge extends toward the rotation direction A side of the blade so as to become close to the main plate, and, on side view, the rear edge portion with a uniform thickness is formed in a substantially L-shape.

Thus, the flow on the rotation direction A face of the blade concentrates on the main plate side and on the side plate side making it difficult to flow in the vicinity of the center. Also, since the half-rotation direction A face of the blade has a substantially same L-shape as that of the rotation direction A face, a distance between vanes of the adjacent blades is the same in the height direction of the impeller, and the flow concentrates to the main plate side and the side plate side on the rotation direction A face. Therefore, the flow becomes unstable in the vicinity of the center in the height direction and separation of air may occur, which might incur an increase of noise.

Moreover, since in a horizontal section crossing the rotary shaft of the blade at a right angle, the thickness of the blade in an arbitrary radius around a rotation center O is the same in the height direction of the impeller, in the case of molding using a thermoplastic resin such as ABS or Ps as a material, the blade becomes solid and the weight thereof may increase.

(iii) In the turbo fan disclosed in Patent Literature 3, since a rear edge portion on the blade is serrated, pressure gradient and velocity loss of merging air flow merging at the rear edge portion are reduced as compared to those with a linear rear edge portion, whereby turbulent flow is suppressed and noise can be reduced, but uneven air-velocity distribution might generate a local high air-velocity region.

The present invention was made to solve the above problems and an object thereof is to obtain a turbo fan that can suppress separation of air flow or turbulent flow (generation of vortex) and an air conditioner on which the turbo fan is mounted.

Solution to Problem

A turbo fan according to the present invention has a disk-shaped main plate provided with a rotation center at the center and a projecting boss formed in the vicinity of the rotation center;

a cylindrical shroud arranged opposite to the main plate and provided with a diameter expanded portion whose inner diameter becomes more expanded, the closer it becomes to the main plate; and a plurality of blades with the one end and the other end joined to the main plate and the shroud respectively; in which, a blade rear edge of the blade is located on a virtual cylinder formed by an outer periphery of the main plate and an outer periphery of the shroud, a blade front edge of the blade is located closer to the rotation center than the blade rear edge of the blade, and a virtual line which connects the blade rear edge and the blade front edge is inclined with respect to a radial line of the main plate from the rotation center, in which a blade outer face, which is a face away from the rotation center of the blade, is formed on a projecting face projecting in a direction away from the rotation center, in which the blade front edge is divided into a main-plate-side blade front edge close to the main plate, a shroud-side blade front edge close to the shroud, and a projecting blade front edge formed between the main-plate-side blade front edge and the shroud-side blade front edge, in which in a range of the main-plate-side blade front edge close to the main plate, a main-plate-side front-edge skirt portion is formed to distance away from the blade rear edge and incline away from the rotation center the closer it becomes to the main plate, in which in a range farther away from the main plate than the main-plate-side front-edge skirt portion, a main-plate-side front-edge vertical portion perpendicular to the main plate is formed, in which in a range farther away from the main plate than the main-plate-side front-edge vertical portion, with respect to the main-plate-side front-edge vertical portion, a main-plate-side front edge inclined portion is formed to distance away from the blade rear edge and incline away from the rotation center the farther it becomes to the main plate, in which a range closer to the main plate than a projecting front-edge end point of the projecting blade front edge continuing from the main-plate-side front edge inclined portion distances away from the blade rear edge and distances away from the rotation center the farther it becomes to the main plate, and in which a range farther away from the main plate than the projecting front edge end point of the projecting blade front edge continuing to the shroud-side blade front edge becomes closer to the blade rear edge and is distanced away from the rotation center the farther it becomes to the main plate.

Advantageous Effects of Invention

In the turbo fan according to the present invention, a blade outer face in a blade front edge has in a range close to the main plate, a main-plate-side front-edge skirt portion, which gradually becomes closer to the blade rear edge and is inclined to become closer to the rotation center as it furthers away from the main plate, a main-plate-side front-edge vertical portion continuous to that, a main-plate-side front edge inclined portion inclined in the direction away from the rotation center while gradually distancing away from the blade rear edge than the main-plate-side front-edge vertical portion as it furthers away from the main plate, a projecting blade front edge continuing from the main-plate-side front edge inclined portion projecting in the direction away from the rotation center the farthest away from the blade rear edge as it furthers away from the main plate, and the shroud-side blade front edge continuous with the projecting blade front edge and inclined in the direction away from the rotation center while becoming close to the blade rear edge as it furthers away from the main plate.

That is, the blade front edge has a "reverse outward warp" curved in the direction away from the rotation center at the front portion advancing in the rotation direction close to the main plate and the range including the projecting blade front edge. Thus, drawing of the sucked flow is facilitated.

Also, since the main-plate-side front-edge skirt portion (an angle formed with the main plate is an obtuse angle) is provided, air flowing into the vicinity of the main plate flows close to the center of the curve (substantially corresponding to the joint position between the main-plate-side front-edge vertical portion and the main-plate-side front edge inclined portion), concentration of the flow to the main-plate-side can be avoided. Thus, the overall air velocity can be equalized.

Also, on side view, since the projecting front edge end point advances farther in the rotation direction as compared to the main-plate-side front-edge vertical portion (identical with a front-edge curved point), a "triangular vane shape" is formed having the projecting front edge end point as an apex and the shroud-side blade front edge and the projecting blade front edge (including the main-plate-side front edge inclined portion) as two sides, a vertical vortex from the blade outer peripheral face to the inner peripheral face is generated, which draws the flow to a blade inner face, and even if air-flow resistance is changed on the suction side, the flow is supplied to the blade surface by the vertical vortex and separation of air does not occur.

As described above, the turbo fan according to the present invention can equalize the velocity of air passing between blades and prevent separation of air on the blade surface, and noise reduction can be realized.

DESCRIPTION OF EMBODIMENTS

Embodiment 1

Air Conditioning Apparatus

Figure 1:
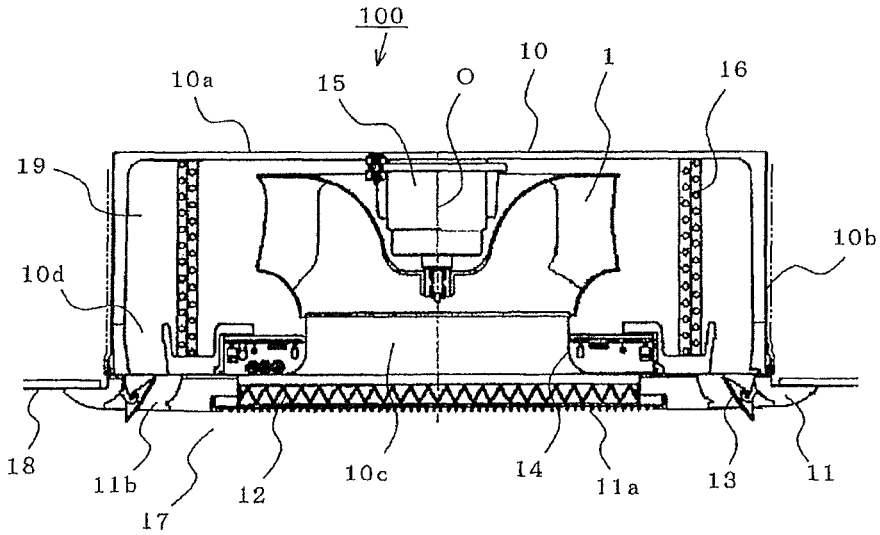
FIG. 1 is a longitudinal sectional view schematically illustrating an air conditioner according to Embodiment 1 of the present invention.

FIG. 1 is a longitudinal sectional view schematically illustrating an air conditioning apparatus according to Embodiment 1 of the present invention. In FIG. 1, a ceiling-concealed type air conditioning apparatus 100 is concealed in a recess portion 19 formed in a ceiling face 18 of a room 17 and has an air conditioning apparatus main body 10, and a turbo fan 1 and a heat exchanger 16 contained in the air conditioning apparatus main body 10.

The air conditioning apparatus main body 10 is a housing formed of a main-body side plate 10*b* forming a cylindrical body having a rectangular section and a main-body top plate 10*a* formed of a rectangular plate material closing one of end faces of the cylindrical body; a decorative panel 11 is detachably attached to an opening portion of the housing (a face opposing the main-body top plate 10*a*). That is, the main-body top plate 10*a* is located above the ceiling face 18, and the decorative panel 11 is located substantially on the same face as the ceiling face 18.

In the vicinity of the center of the decorative panel 11, a suction grill 11*a*, which is an air inlet for the air conditioning apparatus main body 10, is formed and a filter 12 that removes dust in the air that has passed through this grill is arranged in the suction grill 11*a*.

On the other hand, along each side of the decorative panel 11, that is, so as to surround the suction grill 11*a*, a panel blow-out port 11*b*, which is an air blow-out port, is formed, and an air-direction vane 13 that adjusts the direction of blowing-out air is installed in the panel blow-out port 11*b*.

A fan motor 15 is installed at the center of the main-body top plate 10*a*, and the turbo fan 1 is set to the rotary shaft of the fan motor 15.

Between the suction grill 11*a* and the turbo fan 1, a bell mouth 14 that forms a suction air path from the former to the latter is arranged, and the heat exchanger 16 is arranged so as to surround (in a substantially C-shape on a plan view, for example) the outer peripheral side of the turbo fan 1.

The heat exchanger 16 has fins arranged substantially horizontally at predetermined intervals and a heat transfer pipe penetrating through the fins, and the heat transfer pipe is connected to an outdoor unit by a connection pipeline (either of them is not shown) to which a cooled refrigerant or a heated refrigerant is supplied.

Therefore, in the air conditioning apparatus 100 configured as above, when the turbo fan 1 is rotated, air in the room 17 is sucked into the suction grill 11*a* of the decorative panel 11. The air from which dust is removed in the filter 12 is then guided to the bell mouth 14 that forms a main-body inlet 10*c* and is sucked into the turbo fan 1.

In the turbo fan 1, the air sucked substantially upward from below is blown out substantially horizontally. Then, the blown-out air has heat exchanged or humidity adjusted while passing through the heat exchanger 16, has the flow direction thereof changed substantially downward, and is blown out of the panel blow-out port 11*b* into the room 17. At this time, the air direction is controlled by the air-direction vane 13 at the panel blow-out port 11*b*.

Since the turbo fan 1 is the same as a turbo fan according to Embodiment 2 of the present invention, which will be described in detail separately, the air conditioning apparatus 100 with high quality, high performance, and low noise can be realized.

That is, if either the main-body inlet 10*c* side or the panel blow-out port 11*b* side of the turbo fan 1, or both, has a pressure-loss body capable of passing air through it, and if the pressure-loss body capable of flowing air arranged in the inlet is the filter 12, for example, even if dust accumulates during a long-time operation and air-flow resistance is increased, since a blade front edge 4*a* is curved, separation of air does not easily occur and low noise can be maintained even in the long-time operation. Also, if the pressure-loss body disposed in the panel blow-out port 11*b* is the heat exchanger 16 or a humidifying rotor, for example, since air-velocity distribution is even, effective heat exchange or humidity emission can be accomplished in the entire heat exchanger 16 or the humidifying rotor. Also, even if the heat exchanger 16 is substantially square in shape and distances between the turbo fan 1 and the heat exchanger 16 are not uniform, separation of air does not occur and low noise can be realized (this will be described in detail separately).

Embodiment 2

Turbo Fan

Figure 2:
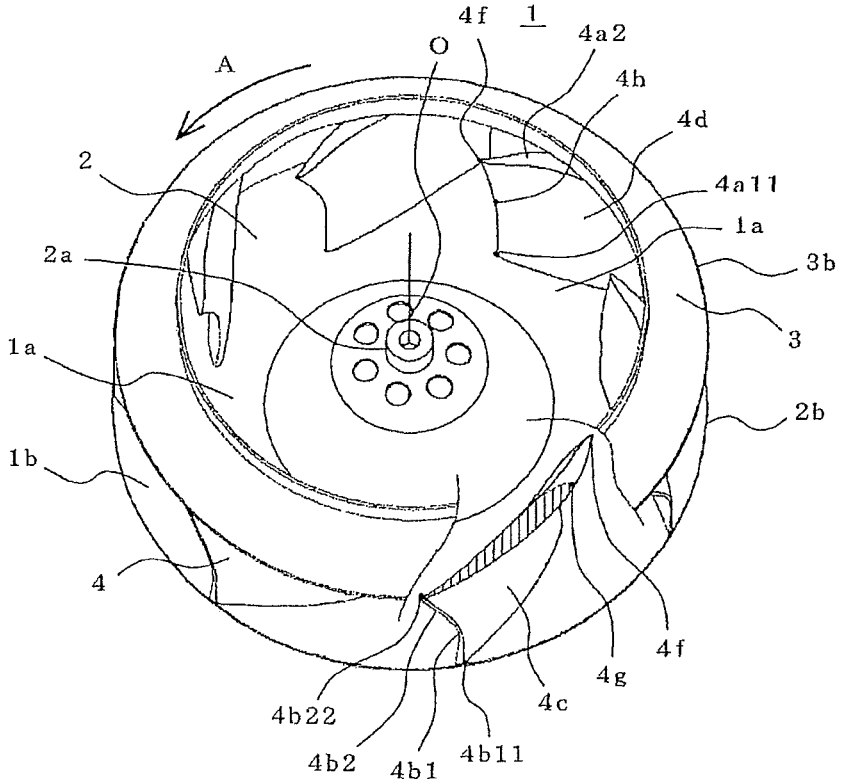
FIG. 2 is a perspective view schematically explaining a turbo fan according to Embodiment 2 of the present invention.
Figure 3:
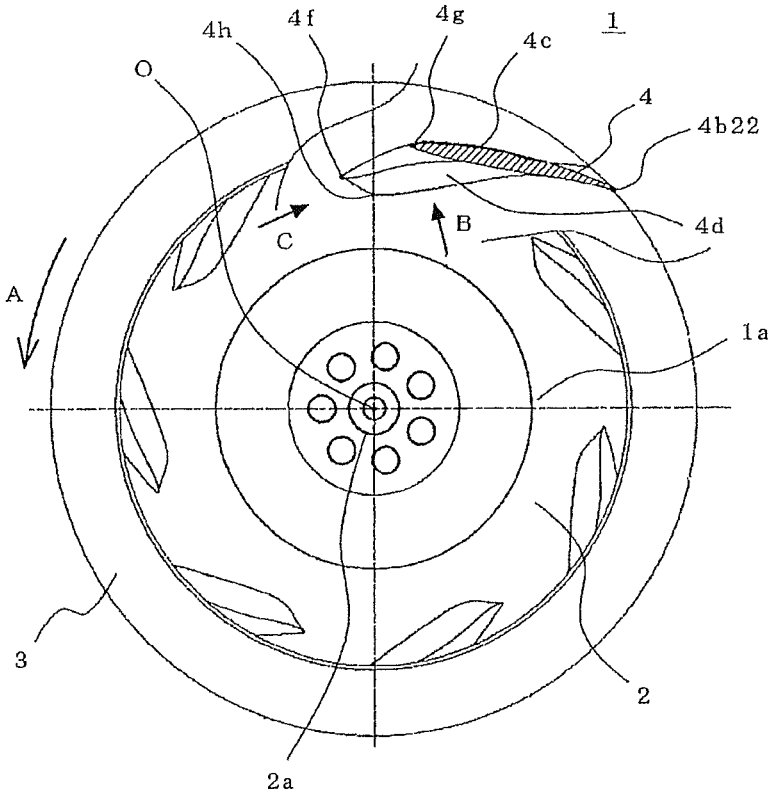
FIG. 3 is a plan view schematically explaining the turbo fan shown in FIG. 2.
Figure 4:
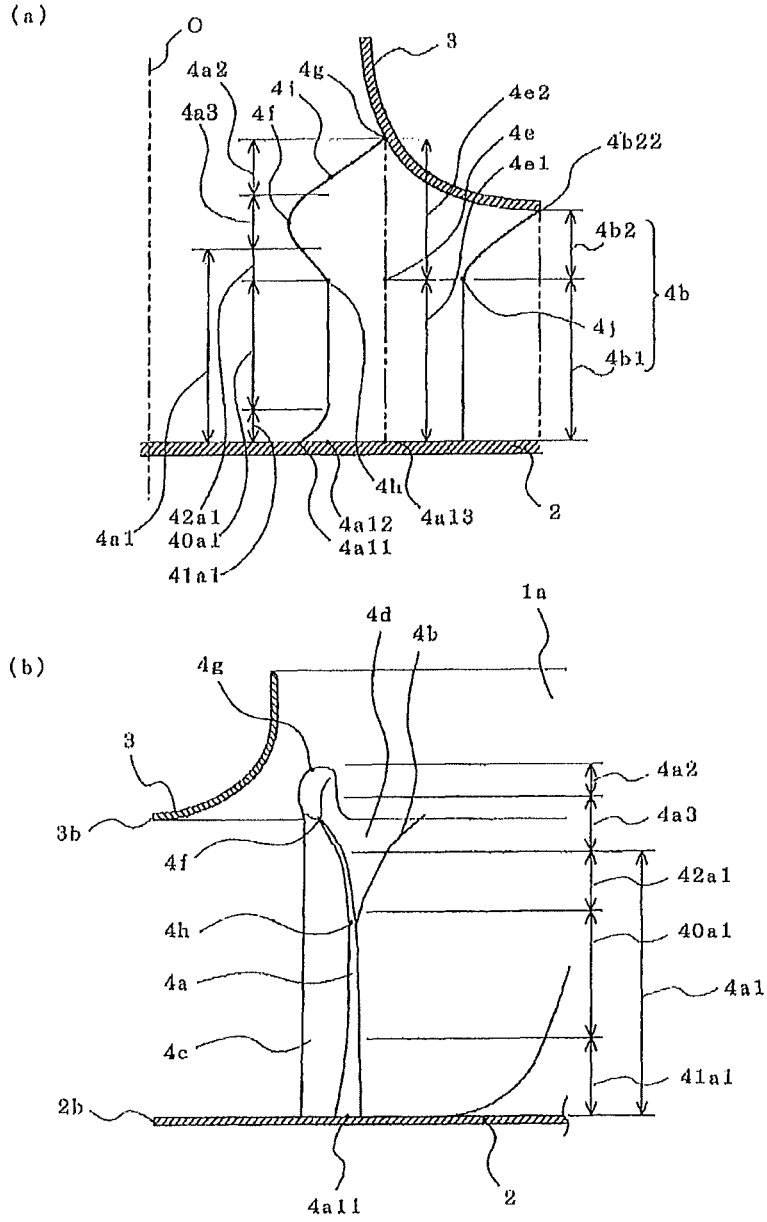
FIGS. 4*a* and 4*b* are enlarged side views for schematically explaining the turbo fan shown in FIG. 2.
Figure 5:
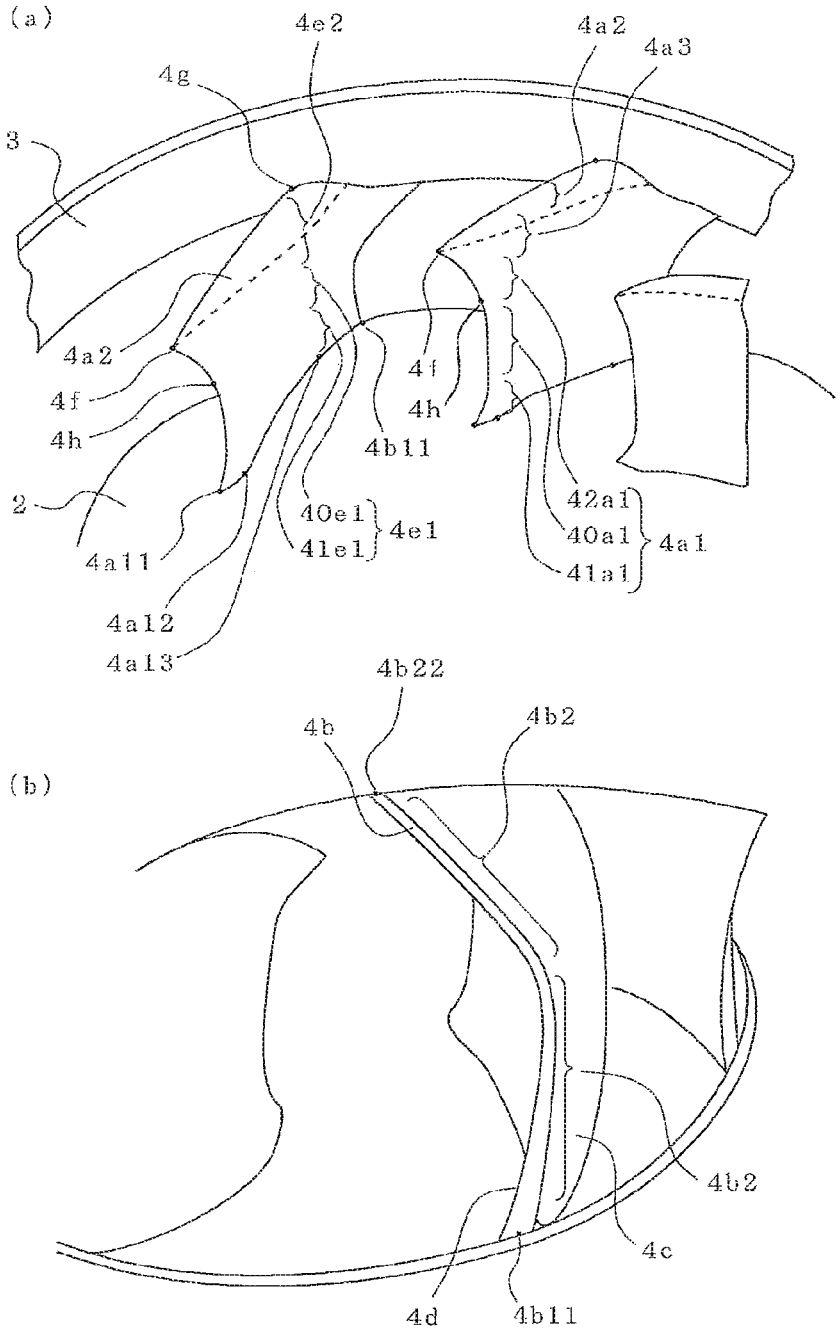
FIGS. 5*a* and 5*b* are perspective views illustrating a blade front edge and a blade rear edge of the turbo fan shown in FIG. 2.
Figure 9:
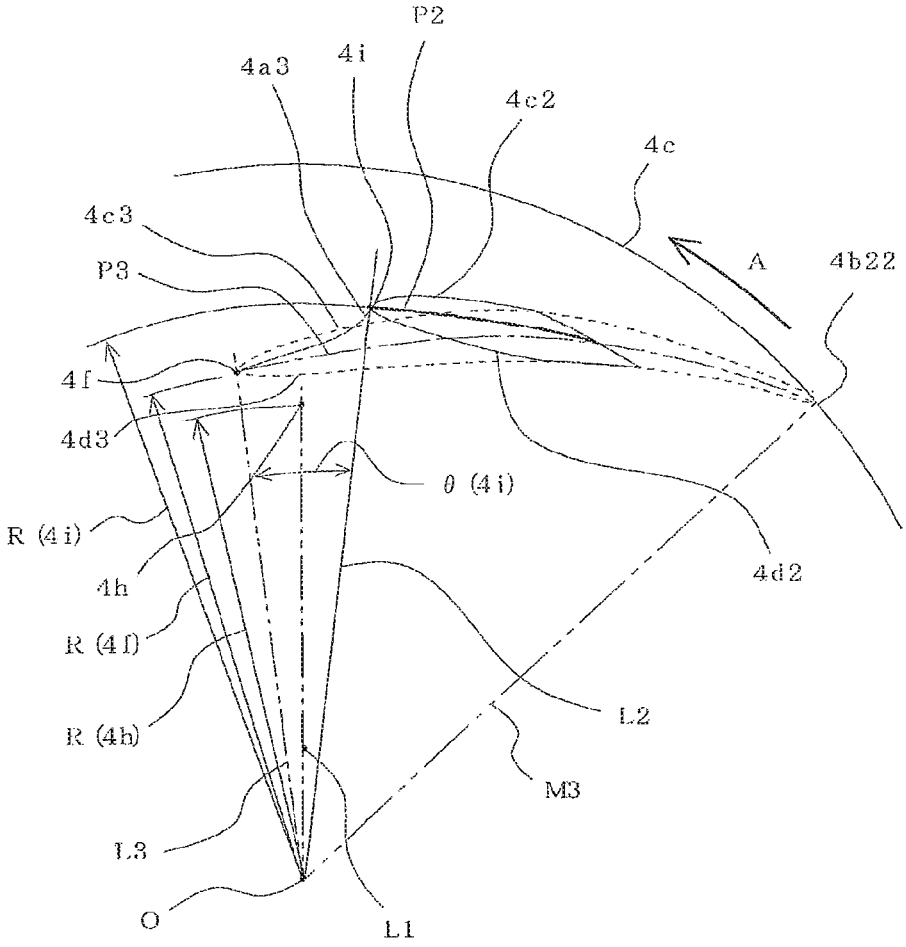
FIG. 9 is a sectional view on plan view of the turbo fan shown in FIG. 2 (shroud-side blade front edge).
Figure 10:
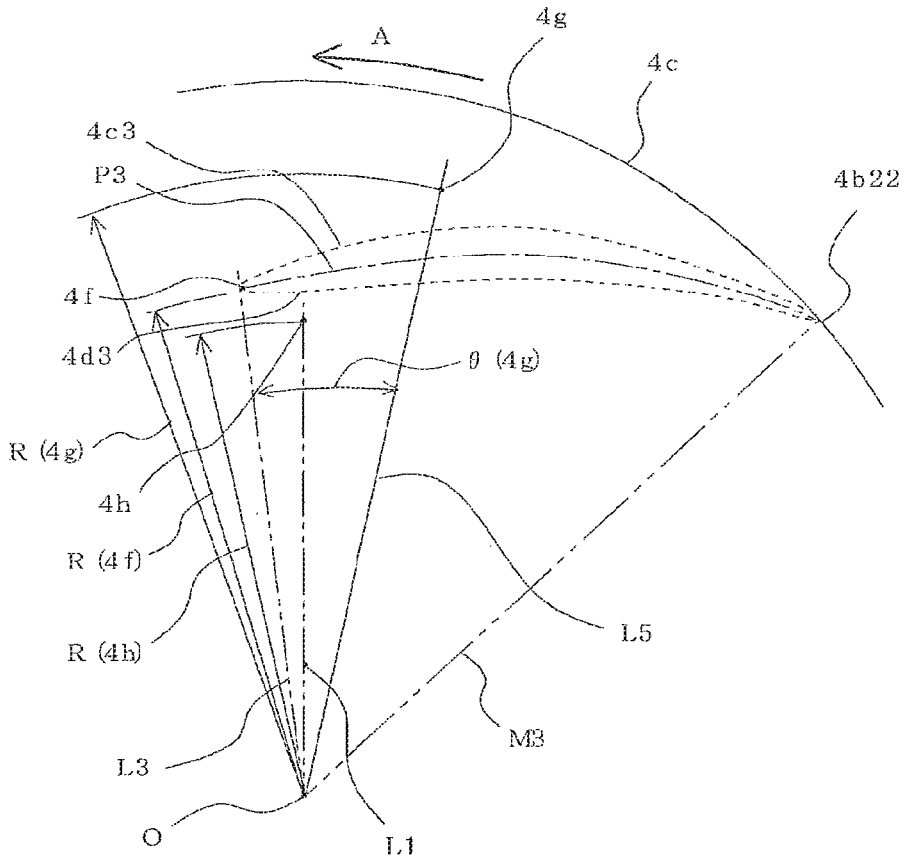
FIG. 10 is a sectional view on plan view of the turbo fan shown in FIG. 2 (shroud-side front-edge end point).
Figure 11:
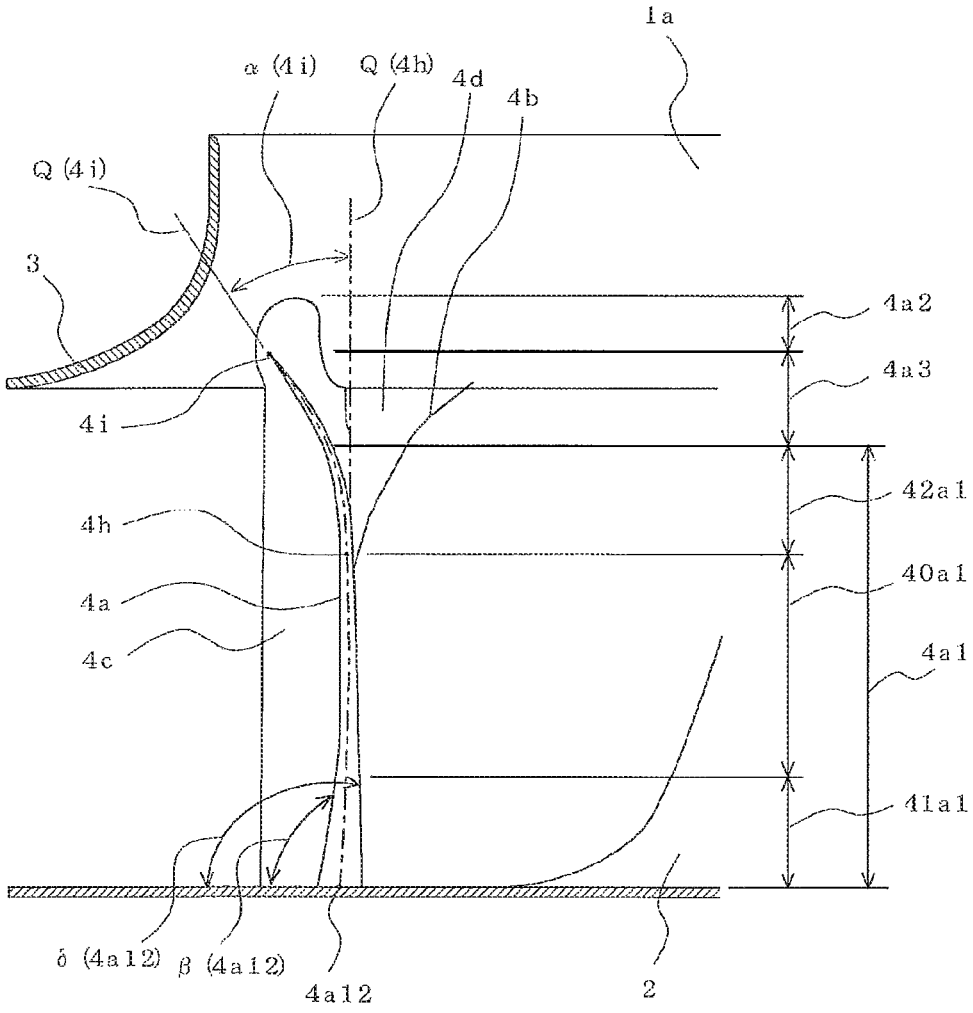
FIG. 11 is a sectional view on side view of the turbo fan shown in FIG. 2 (the position of the blade front-edge curved point).
Figure 12:
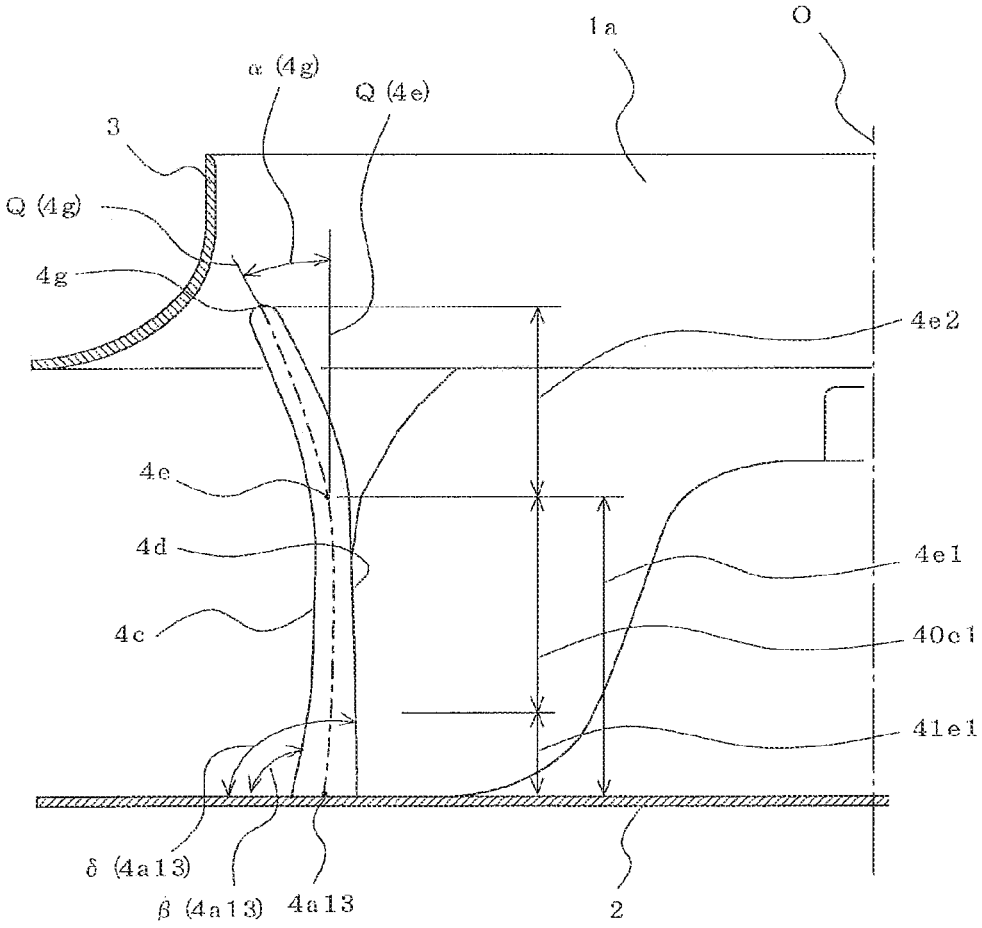
FIG. 12 is a sectional view on side view of the turbo fan shown in FIG. 2 (shroud-side blade front edge).
Figure 13:
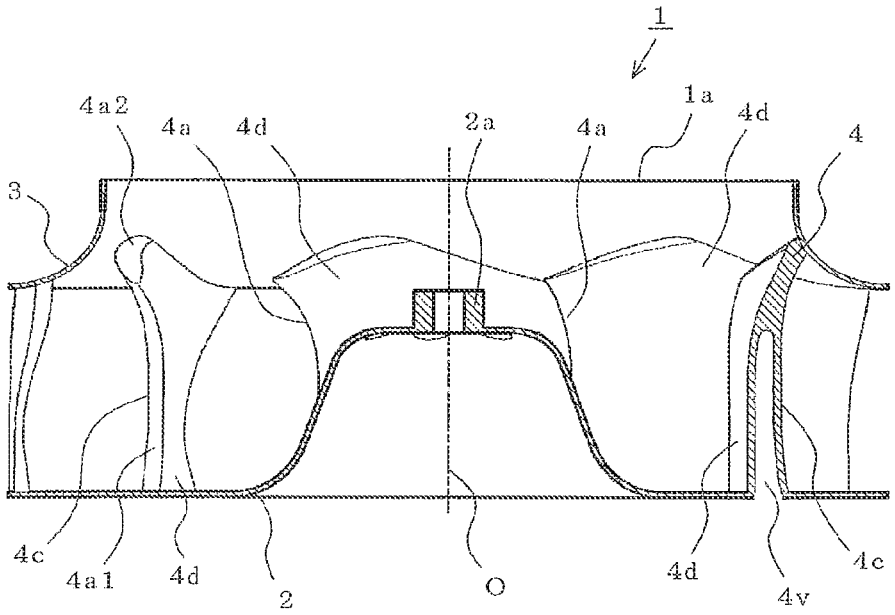
FIG. 13 is a sectional view on side view of the turbo fan shown in FIG. 2 (shroud-side blade front edge).
Figure 14:
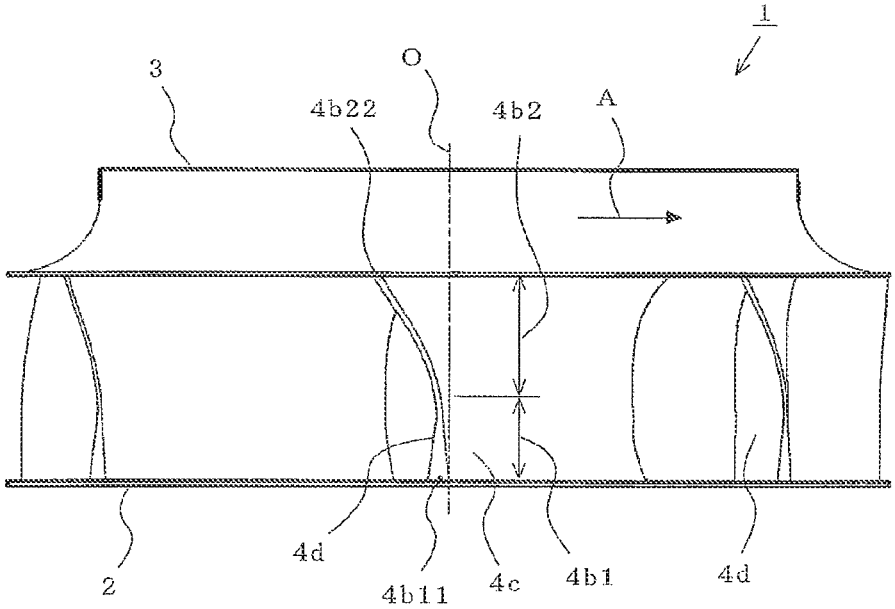
FIG. 14 is a sectional view illustrating the blade rear edge of the turbo fan shown in FIG. 2.
Figure 15:
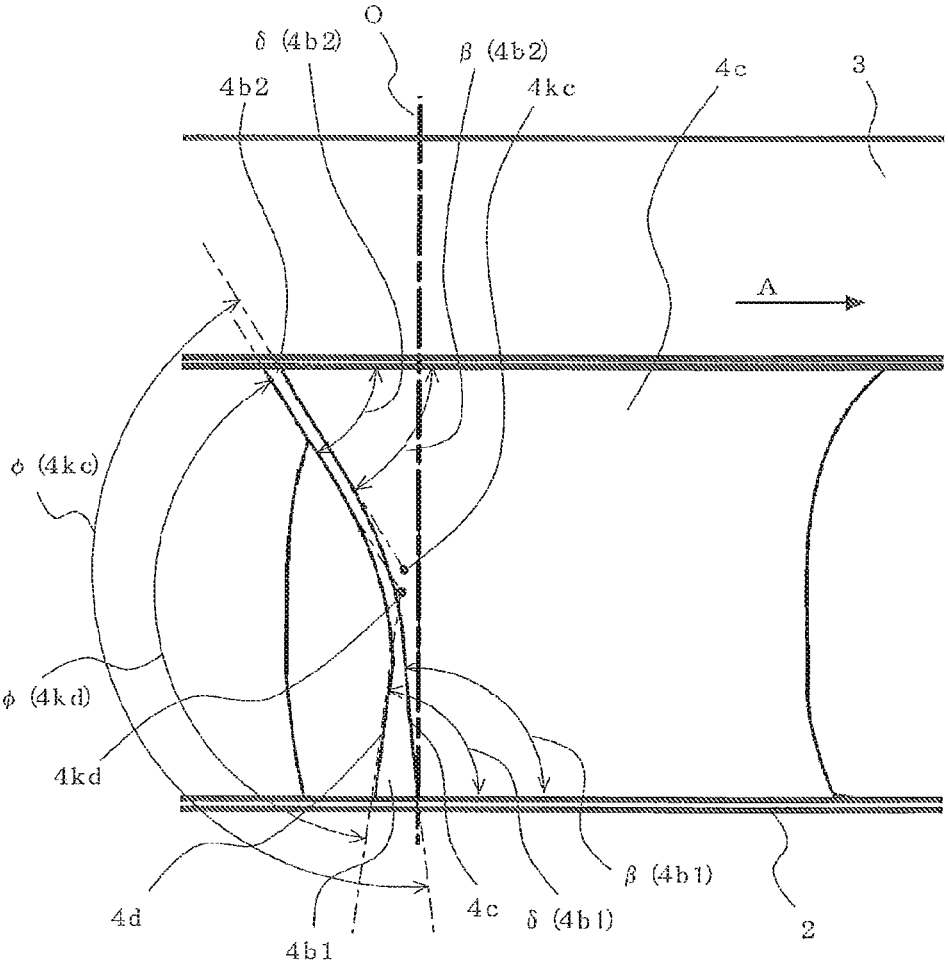
FIG. 15 is an extended view illustrating the blade rear edge of the turbo fan shown in FIG. 2.

FIGS. 2 to 15 schematically explain a turbo fan according to Embodiment 2 of the present invention, in which FIG. 2 is a perspective view, FIG. 3 is a plan view, FIG. 4(*a*) is an enlarged side view of a partial section (seen in an arrow B direction shown in FIG. 3), FIG. 4(*b*) is an enlarged side view of a partial section (seen in an arrow C direction shown in FIG. 3), FIG. 5(*a*) is a perspective view schematically illustrating a blade front edge, FIG. 5(*b*) is a perspective view schematically illustrating a blade rear edge, FIGS. 6 to 10 are each sectional views on plan view, FIGS. 11 to 13 are each sectional views on side view, FIG. 14 is a side view illustrating the blade rear edge, and FIG. 15 is an extended view illustrating the blade rear edge.

Turbo fan 1 that is described as the turbo fan mounted on the air conditioning apparatus 100 (Embodiment 1) does not limit the present invention, and is a turbo fan mounted as blowing means in various air conditioning apparatus and devices.

In order to facilitate understanding, the upper side in the figure will be the room 17 side. That is, since it corresponds to a state in which the turbo fan 1 is removed from the ceiling face 18 and the main-body top plate 10*a* is placed on a floor face with the main-body inlet 10*c* faced upward, the air is sucked from an upper part to the lower part of the figure. Also in each figure, the same or corresponding portions are given the same reference numerals and a part of the description will be omitted.

(Entire Configuration)

In FIGS. 2 to 5, the turbo fan 1 is formed of a main plate 2, which is a rotating body in which an outer peripheral part is flat and the center part is projecting in a mountain shape, a substantially annular shroud 3 opposing the main plate 2, and a plurality of blades 4, one end of each being joined to the main plate 2 and the other end to the shroud 3 (same as having been formed integrally).

A shaded part in FIGS. 2 and 3 indicate a state in which the shroud 3 is removed from the blade 4, that is, a joint boundary face between the shroud 3 and the blade 4 is indicated.

At the center of the main plate 2 (equivalent to the top of the mountain-shaped projection portion), a boss 2*a* is formed, and the boss 2*a* is fixed to the rotary shaft of the fan motor 15 (see FIG. 1). The center of the rotary shaft will be hereinafter referred to as a "rotation center O".

The shroud 3 has an upper edge forming a fan inlet 1*a*, and the inner diameter of the shroud becomes larger as it lowers away from the fan inlet 1*a* (getting closer to the main plate 2).

The four portions a lower edge 3*b* of the shroud 3 (the inner diameter is the largest. (hereinafter referred to as a "shroud outer periphery"), an opposing outer periphery 2*b* of the main plate 2 (hereinafter referred to as a "main plate outer periphery"), and blade rear edges 4*b* which is the farthest portion from the rotation center O in a pair of blades 4 are located on the same virtual cylindrical face (hereinafter referred to as a "virtual outer peripheral cylinder"), and the 1*b* is formed (more accurately, since it is formed with the pair of blades 4 walling on both sides, if seven blades were provided, seven fan outlets 1*b* will be formed on the circumference).

(Blade)

In FIGS. 2 to 5, the blade front edge 4*a* of the blade 4 is located at a predetermined distance from the rotation center O, the blade rear edge 4*b* is located on the virtual outer peripheral cylinder, and a virtual line that connects the blade front edge 4*a* and the blade rear edge 4*b* (hereinafter referred to as a "chord line") is inclined with respect to a radial line from the rotation center O.

For convenience of explanation, a direction away from the blade rear edge 4*b* will be referred to as a "rotation direction A (indicated by an arrow A in the figures)" and a direction away from the blade front edge 4*a* as "reverse rotation direction".

A blade outer face 4*c* (corresponding to a positive pressure face), which is a face of the blade 4 away from the rotation center O, is distanced away from the rotation center O as it goes towards the counter-rotation direction, and the blade rear edge 4*b* of the blade 4 is located on the virtual outer peripheral cylindrical face.

Also, a blade inner face 4*d* (corresponding to a negative pressure face), which is a face of the blade 4 closer to the rotation center O, is given a predetermined distance with the blade outer face 4*c* (corresponding to the thickness of the blade 4) and is similar in form to the blade outer face 4*c*. At this time, the predetermined distance (corresponding to the thickness of the blade 4) becomes large in the middle between the blade front edge 4*a* and the blade rear edge 4*b* and gradually becomes small toward both edge portions. That is, the section approximates an airfoil shape.

A line indicating a center position of the blade outer face 4*c* and the blade inner face 4*d* along a plane parallel with the main plate 2 will be referred to as "horizontal warp line P" and a straight line that connects an end point of the blade front edge 4*a* and an end point of the blade rear edge 4*b* will be referred to as a "horizontal chord line S".

(Blade Front Edge Portion)

FIG. 4(*a*) is the blade 4 seen from the rotation center O toward the radial direction (a direction of an arrow B shown in FIG. 3 and substantially the same as the direction perpendicular to a horizontal chord line S1) and FIG. 4(*b*) is the blade 4 seen in the direction of the horizontal chord line S1 (a direction of an arrow C shown in FIG. 3).

The blade front edge 4*a* is, from the main plate 2 to the shroud 3, roughly divided into a main-plate-side blade front edge 4*a*1, a projecting blade front edge 4*a*3, and a shroud-side blade front edge 4*a*2. The main-plate-side blade front edge 4*a*1 is divided into a main-plate-side front-edge vertical portion 40*a*1, which is a range perpendicular to the main plate 2, a main-plate-side front-edge skirt portion 41*a*1, which is a predetermined range neighboring the main plate 2, and a main-plate-side front edge inclined portion 42*a*1, which the end of the main-plate-side front-edge vertical portion 40*a*1 bent at a front-edge curved point 4*h* connects to the projecting blade front edge 4*a*3.

The main divisions such as the main-plate-side blade front edge 4*a*1 and the like and subdivisions such as the main-plate-side front-edge vertical portion 40*a*1 and the like are for convenience of explanation, and a boundary between two parts is not particularly distinct and the respective ranges are not limited by them.

That is, the blade front edge 4*a* is, from a main-plate-side front edge end point 4*a*11, which is a joint part with the main plate 2, to the main-plate-side front-edge skirt portion 41*a*1, gradually retreated in the direction of the blade rear edge 4*b* (in a direction in which the width of the blade is narrowed), and is, in the main-plate-side front-edge vertical portion 40*a*1, in the range from the end of the main-plate-side front-edge skirt portion 41*a*1 to the front-edge curved point 4*h*, perpendicular to the main plate 2.

The main-plate-side front edge inclined portion 42*a*1 is bent at the front-edge curved point 4*h*, advances in a direction opposite the blade rear edge 4*b* (in a direction in which the width of the blade is widened), is located and then, connected to the projecting blade front edge 4*a*3.

The projecting blade front edge 4*a*3 has a substantially arc shape and connects to the projecting blade front edge 4*a*3. Moreover, the projecting blade front edge 4*a*3 on the shroud 3 side connects to the shroud-side blade front edge 4*a*2.

The shroud-side blade front edge 4*a*2 is distanced away from the main plate 2 as it gets closer to the blade rear edge 4*b* and is then connected to the shroud 3 at a shroud-side front-edge end point 4*g*.

(Blade Rear Edge)

The blade rear edge 4*b* is located on a virtual cylinder (virtual outer peripheral cylinder) formed by a main-plate outer periphery 2*b* and the shroud outer periphery 3*b* and is divided into a main-plate-side blade rear edge 4*b*1 and a shroud-side blade rear edge 4*b*2 from the main plate 2 to the shroud 3. The main-plate-side blade rear edge 4*b*1 is a range perpendicular to the main plate 2. The shroud-side blade rear edge 4*b*2 is bent at a rear edge curved point 4*j* whose distance from the main plate 2 is substantially the same and is located farther to the counter-rotation direction (direction in which the width of the blade 4 increases) as it gets closer to the shroud 3 (equal to "retreats"), which is then connected to the shroud 3 at a shroud-side rear edge end point 4*b*22.

(Sectional Shape of Main-Plate-Side Front Edge Portion)

Subsequently, the sectional shape of the blade will be described in detail. FIGS. 6 to 10 illustrate a blade section in a plane parallel with the main plate 2.

Figure 6:
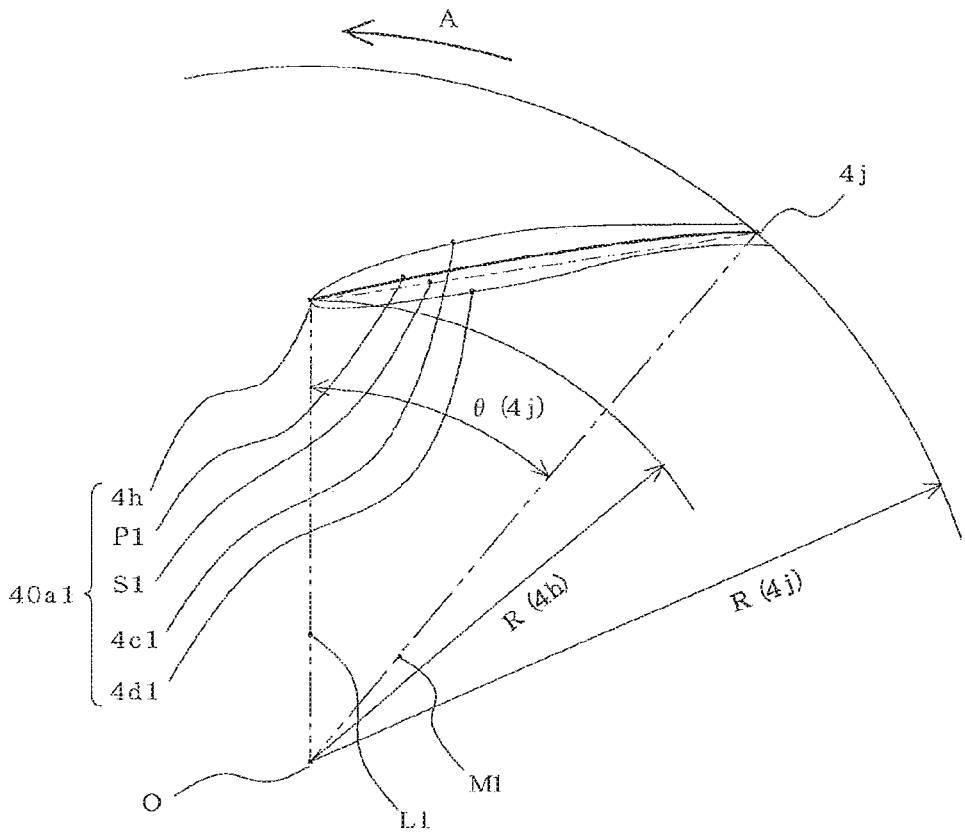
FIG. 6 is a sectional view on plan view of the turbo fan shown in FIG. 2 (the position of a blade front-edge curved point).

FIG. 6 shows a section at the front-edge curved point 4*h*, that is, the main-plate-side front edge vertical portion 40*a*1 (equal to the range of the blade front edge 4*a* perpendicular to the main plate 2) and the rear edge curved point 4*j* (equal to the range of the blade rear edge 4*b* perpendicular to the main plate 2).

The front-edge curved point 4*h* is located at a point with a distance R (4*h*) from the rotation center O. Also, the rear edge curved point 4*j* is located on the virtual outer peripheral cylinder (with a distance R (4*j*) from the rotation center O) at a position delayed in the counter-rotation direction by an angle θ (4*j*) with respect to the front-edge curved point 4*h*.

A blade outer face 4*c*1 is formed on a projecting face projecting in a direction away from the rotation center O. On the other hand, a blade inner face 4*d*1 is formed on a projecting face projecting in a direction close to the rotation center O in a range close to the front-edge curved point 4*h* (equal to being close the front edge 4*a*) and is formed on a recessed face retreating in a direction away from the rotation center O in a range close to the rear edge curved point 4*j* (equal to being close to the rear edge 4*b*).

That is, since the radius of curvature of the blade outer face 4*c*1 when regarded as an arc (actually, it is not an arc) is smaller than the radius of curvature of the blade inner face 4*d*1 when regarded as an arc (actually, it is not an arc), the blade outer face 4*c*1 is more warped than the blade inner face 4*d*1 on the horizontal section.

At this time, the center line between the blade outer face 4*c*1 and the blade inner face 4*d*1 is referred to as a "horizontal warp line P1" and a straight line that connects the front-edge curved point 4*h* and the rear edge curved point 4*j* as a "horizontal chord line S1".

(Sectional Shape of Joint Portion Between Main-Plate-Side Front Edge Portion and Main Plate)

Figure 7:
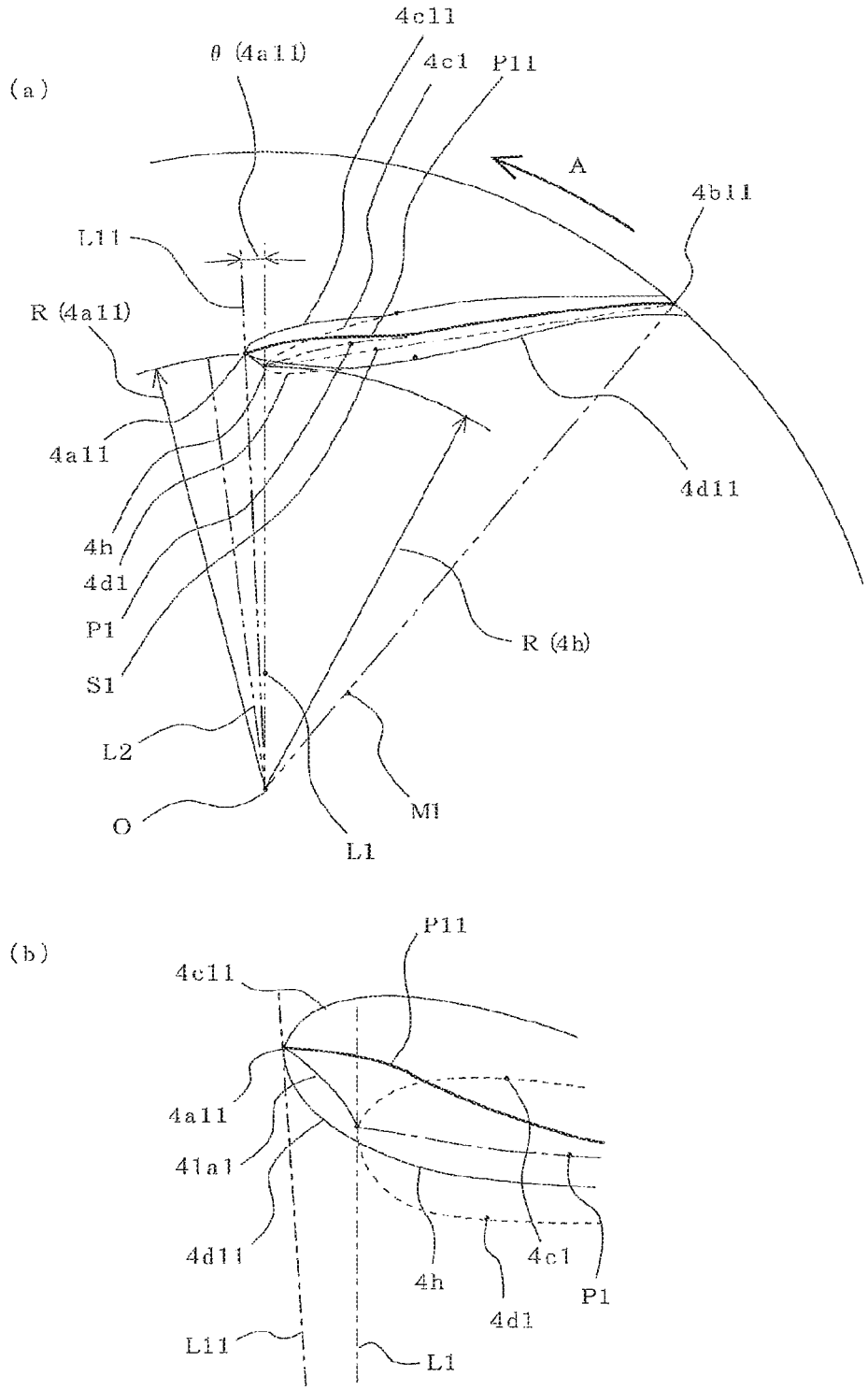
FIGS. 7*a* and 7*b* are sectional views on plan view of the turbo fan shown in FIG. 2 (the position of a main-plate-side front edge end point).

FIG. 7(*a*) illustrates a sectional shape of a joint portion between the main-plate-side blade front edge 4*a*1 and the main plate 2, that is, a section at a main-plate-side front-edge end point 4*a*11 and a main-plate-side rear edge end point 4*b*11, and FIG. 7(*b*) is an enlarged sectional view of a part thereof.

The main-plate-side front-edge end point 4*a*11 is at a position ahead (equal to "advancing") of the front-edge curved point 4*h* in the rotation direction A and is at a position more on the outer periphery side. That is, the end point is located at a distance R (4*a*11) that is larger than the distance R (4*h*) from the rotation center O and ahead in the rotation direction A by the angle θ (4*a*11). Also, the main-plate-side rear edge end point 4*b*11 is located in the same phase as that of the rear edge curved point 4*j*. Therefore, the width of the blade 4 at the position is larger by a portion corresponding to the angle θ (4*a*11).

A blade outer face 4*c*11 is formed on a projecting face projecting in a direction away from the rotation center O. At this time, a predetermined range of the blade outer face 4*c*11 close to the main-plate-side front-edge end point 4*a*11 is dislocated (deviated) from the blade inner face 4*d*1 (range perpendicular to the main plate 2), and the range away from the main-plate-side front-edge end point 4*a*11 is perpendicular to the main plate 2 and is the same as the blade outer face 4*c*1.

Similarly, the predetermined range of a blade inner face 4*d*11 close to the main-plate-side front-edge end point 4*a*11 is formed on a projection face projecting in a direction coming close to the rotation center O, and the range away from the main-plate-side front-edge end point 4*a*11 is perpendicular to the main plate 2 and is the same as the blade inner face 4*d*1.

The blade outer face 4*c*11 and the blade outer face 4*c*1 as well as the blade inner face 4*d*11 and the blade inner face 4*d*1 are connected to each other smoothly and form the main-plate-side front-edge skirt portion 41*a*1.

(Sectional Shape of Projecting Blade Front Edge)

Figure 8:
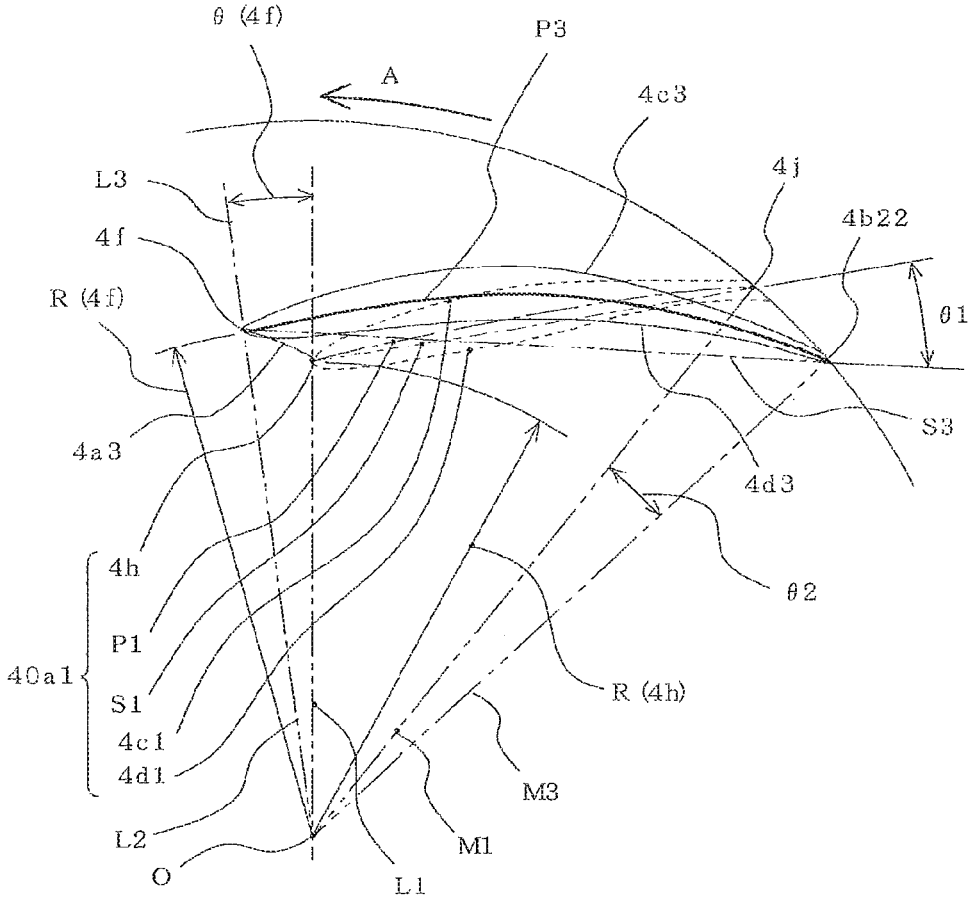
FIG. 8 is a sectional view on plan view of the turbo fan shown in FIG. 2 (the position of a projecting front edge end point).

FIG. 8 is a section at the projecting blade front edge 4*a*3 and a section at the shroud-side rear edge end point 4*b*22.

The projecting blade front edge 4*a*3 is located at a position ahead in the rotation direction A and more on the outer periphery side with respect to the front-edge curved point 4*h*. At this time, a projecting front-edge end point 4*f* located on the outermost periphery of the projecting blade front edge 4*a*3 (equal to a position advanced the most in the rotation direction A) is located at a distance R (4*f*) larger than the distance R (4*h*) from the rotation center O and is advanced in the rotation direction A by an angle θ (4*f*).

That is, as being away from the main plate 2, the main-plate-side front-edge inclined portion 42*a*1 and the projecting blade front edge 4*a*3 are gradually located on the "outer periphery side and the rotation direction A side) with respect to the front-edge curved point 4*h* and continues to the projecting front-edge end point 4*f*, which is a position advanced the most in the rotation direction A.

On the other hand, the shroud-side rear edge end point 4*b*22 is located on the virtual outer peripheral cylinder and is behind in the counter-rotation direction by an angle θ (4*b*22). That is, the blade rear edge 4*b* is constituted by the main-plate-side blade rear edge 4*b*1, which is perpendicular to the main plate 2, and the shroud-side blade rear edge 4*b*2, which is bent at the rear edge curved point 4*j* and retreated more in the counter-rotation direction (direction in which the width of the blade 4 increases) as it gets closer to the shroud 3.

Therefore, the width of the blade 4 at this position is larger than the width of the section at the front-edge curved point 4*h* (equal to the front-edge curved point 4*h*) by a portion corresponding to the angle "(θ (4*f*)+θ (4*b*22)".

A blade outer face 4*c*3 is formed on the projecting face projecting in the direction away from the rotation center O. On the other hand, a blade inner face 4*d*3 is, in the range close to the projection front-edge end point 4*f* (equal to being close to the front edge 4*a*), formed on the projecting face projecting in the direction closer to the rotation center O and, in the range close to the shroud-side rear edge end point 4*b*22 (equal to being close to the rear edge 4*b*), formed on a recessed face retreating in the direction away from the rotation center O.

At this time, the center line between the blade outer face 4*c*3 and the blade inner face 4*d*3 is referred to as a "horizontal warp line P3" and a straight line that connects the projecting front-edge end point 4*f* and the shroud-side rear edge end point 4*b*22 as a "horizontal chord line S3".

(Sectional Shape of Shroud-Side Blade Front Edge)

FIG. 10 shows a section in the shroud-side blade front edge 4*a*2. In FIG. 9, if a predetermined position 4*i* of the shroud-side blade front edge 4*a*2 has a distance R (4*i*) from the rotation center O and an angle θ (4*i*) retreating in the counter-rotation direction with respect to the projecting front-edge end point 4*f*, the farther the position 4*i* is away from the projecting front-edge end point 4*f*, the more the position retreats in the counter-rotation direction, and the position is located to the main-plate outer periphery 2*b*.

That is, the farther the position 4*i* is away from the main plate 2 (equal to the closer the position is to the shroud 3), the angle θ (4*i*) and the distance R (4*i*) become gradually larger. Therefore, the range of a blade outer face 4*c* and the blade inner face 4*d* close to the shroud-side blade front edge 4*a*2 has a substantially triangular shape bent in a substantially arc state.

A line indicating the blade outer face 4*c* and the blade inner face 4*d* in the section including the position 4*i* is referred to as a blade outer face 4*c*2 and a blade inner face 4*d*2, and the center line between the blade outer face 4*c*2 and the blade inner face 4*d*2 as a "horizontal warp line P2". At this time, since the side away from the rotation center O of the section including the position 4*i* is in contact with the shroud 3, the farther the position 4*i* is away from the main plate 2, the shorter the length of the horizontal warp line P2 becomes.

(Position of the Shroud-Side Front-Edge End Point 4*g*)

FIG. 10 shows a section in the shroud-side blade front edge 4*a*2. In FIG. 9, the shroud-side front-edge end point 4*g* retreats from (is behind of) the projecting front-edge end point 4*f* in the counter-rotation direction by an angle θ (4*g*) at a distance (4*g*) from the rotation center O. That is, a relationship of "R (4*i*)<R (4*g*), θ (4*i*)<θ (4*g*)" is formed.

Summarizing the above, the following relationships are formed:

"$R(4a11)>R(4h)$",

"$R(4h)<R(4f)<R(4i)<R(4g)$",

"$\theta(4a11)\neq 0$",

"$\theta(4f)\neq 0$",

"$0\neq\theta(4i)<\theta(4g)$".

(Warp of Blade Front Edge)

FIG. 11 is a sectional view for explaining the warp in the blade front edge 4*a* showing a section of a face perpendicular to the main plate 2 passing through the front-edge curved point 4*h* (more accurately, a section perpendicular to the main plate 2 and the horizontal chord line S1 (See FIG. 6)).

In FIG. 11, a perpendicular line to the main plate 2 passing through the front-edge curved point 4*h* is referred to as a "perpendicular line Q (4*h*)" and, for convenience of explanation, the position 4*i* happens to be located on the perpendicular line Q (4*h*). The center line between the blade outer face 4*c* and the blade inner face 4*d* (indicated by a one-dot chain line in the figure) is referred to as a "perpendicular warp line Q (4*i*)" and an intersection between the perpendicular warp line Q (4*i*) and the main plate 2 is referred to as a main-plate-side front-edge warp point 4*a*12.

Since the range of the blade outer face 4*c* corresponding to the main-plate-side front-edge skirt portion 41*a*1 is inclined more inward (to the right side in the figure) as it distances itself away from the main plate 2, an inclination angle β (4*a*12) formed with the main plate 2 is an obtuse angle (β (4*a*12)>90°). On the other hand, since the range corresponding to the main-plate-side front-edge skirt portion 41*a*1 of the blade inner face 4*d* is substantially perpendicular to the main plate 2, an inclination angle δ (4*a*12) formed with the main plate 2 is approximately 90° (δ (4*a*12)≅90°).

Therefore, the perpendicular warp line Q (4*i*) is inclined more inward as it is distanced away from the main plate 2 in the range corresponding to the main-plate-side front-edge skirt portion 41*a* close to the main plate 2. Since the main-plate-side front-edge vertical portion 40*a*1, which is farther away from the main plate 2, is perpendicular to the main plate 2, the portion matches the perpendicular line Q (4*h*).

Moreover, in the main-plate-side front-edge inclined portion 42*a*1, the perpendicular warp line Q (4*i*) inclines more outward the more it is away from the main plate 2 with respect to the perpendicular line Q (4*h*) and its inclination becomes gradually larger the more it is away from the main plate 2, and in the projecting blade front edge 4*a*3, a warp angle α (4*i*) is substantially constant.

Therefore, as for the blade 4, in the vicinity of the blade front edge 4*a*, the blade outer face 4*c* is warped more largely than the blade inner face 4*d* (if approximating an arc, the radius of curvature of the former is smaller than the radius of curvature of the latter).

(Warp of Blade Intermediate Part)

FIG. 12 is a sectional view for explaining the warp in the blade intermediate part and shows a section of a plane perpendicular to the main plate 2 passing through the shroud-side front-edge end point 4*g* (more accurately a section perpendicular to the main plate 2 and the horizontal chord line S1 (See FIG. 6)).

In FIG. 12, in the plane of the main plate 2 and the horizontal chord line S1 passing through the shroud-side front-edge end point 4*g*, a position having the same distance from the main plate 2 as that of the front-end curved point 4*h* is referred to as an "intermediate curved point 4*e*".

At this time, with the intermediate curved point 4*e* as a boundary, the intermediate part of the blade 4 is roughly divided into a main-plate-side blade intermediate portion 4*e*1 close to the main plate 2 and a shroud-side blade intermediate portion 4*e*2 on the shroud 3 side. Also, the main-plate-side blade intermediate portion 4*e*1 is smally-divided into a main-plate-side intermediate skirt portion 41*e*1, which is a predetermined range close to the main plate 2, and a main-plate-side intermediate vertical portion 40*e*1, which is a range perpendicular to the main plate 2 away from the main plate 2.

The main-plate-side intermediate skirt portion 41*e*1, the main-plate-side intermediate vertical portion 40*e*1, and the shroud-side blade intermediate portion 4*e*2 continue to each other smoothly and their boundaries (intermediate curved point 4*e*) are not limited by them. And a line perpendicular to the main plate 2 passing through the intermediate curved point 4*e* is referred to as a perpendicular line Q (4*e*). Also, the center line between the blade outer face 4*c* and the blade inner face 4*d* (indicated by a one-dot chain line in the figure) is referred to as a "perpendicular warp line Q (4*g*)" and an intersection between the perpendicular warp line Q (4*g*) and the main plate 2 is referred to as a main-plate-side intermediate warp point 4*a*13.

Since in the range of the main-plate-side intermediate skirt portion 41*e*1 of the blade outer face 4*c* close to the main plate 2, the perpendicular warp line Q (4*g*) is inclined more inward (to the right side in the figure) as it distances itself away from the main plate 2, an inclination angle β (4*a*13) formed with the main plate 2 is an obtuse angle (β (4*a*13) >90°). On the other hand, since the range corresponding to the main-plate-side intermediate vertical portion 40*e*1 of the blade inner face 4*d* is substantially perpendicular to the main plate 2, an inclination angle δ (4*a*13) formed with the main plate 2 is approximately 90° (δ (4*a*13)≅90°).

Also, the perpendicular warp line Q (4*g*) is inclined more inward as it is distanced away from the main plate 2 in the range close to the main plate 2. Since the main-plate-side intermediate vertical portion 40*e*1, which is farther away from the main plate 2, is perpendicular to the main plate 2, the portion matches the perpendicular line Q (4*e*).

Moreover, in the shroud-side blade intermediate portion 4*e*2, the perpendicular warp line Q (4*g*) inclines more outward the more it is away from the main plate 2 with respect to the perpendicular line Q (4*h*) and its inclination becomes gradually larger the more it is away from the main plate 2, and in the range close to the shroud 3, a warp angle α (4*g*) is substantially constant.

The warp angle α (4*i*) of the perpendicular warp line Q (4*i*) in the blade front edge 4*a* (more accurately, at the position corresponding to the front-edge curved point 4*h*) is larger than the warp angle α (4*g*) of the perpendicular warp line Q (4*g*) at the intermediate curved point 4*e* (the position corresponding to the shroud-side front-edge end point 4*g*). That is, a relationship of "(α (4*i*)>α (4*g*)" is formed.

That is, the closer the blade 4 is to the rotation center O (blade front edge 4*a*), the warp angle in the range away from the main plate 2 becomes gradually larger.

(Action/Effect in Blade Front-Edge Portion)

(a) Since the range close to the blade front edge 4*a* is shaped so that the blade outer face 4*c*1 is warped more largely than the blade inner face 4*d*1 on plan view (corresponding to the state in which the radius of curvature of the former is smaller than the radius of curvature of the latter), drawing of the sucked flow drawn by the turbo fan 1 is facilitated.

(b) Since the main-plate-side front-edge end point 4*a*11 has the main-plate-side front-edge end point 4*a*11 advancing in the rotation direction A from the main-plate-side front-edge vertical portion 40*a*1 (equal to the front-edge curved point 4*h*) and is located farther from the rotation center O on plan view, and the inclination angle β (4*a*12) formed by the main-plate-side front-edge skirt portion 41*a*1 and the main plate 2 is an obtuse angle on side view, the air flowing into the vicinity of the main plate 2 flows into the main plate 2 and the most recessed portion in the middle area in the impeller's height direction where it curves in a recess shape, avoids concentration of flow to the main plate 2 side and equalizes the overall air velocity.

(c) On plan view, since the radius of curvature of the blade inner face 4*d* can be regarded to be larger than the radius of curvature of the blade outer face 4*c*, an angle of attack with the flow flowing into the shroud-side blade front edge 4*a*2 is reduced and air flows in smoothly, whereby separation of air is prevented and turbulent flow hardly occurs.

(d) On side view, since the warp angle α (4*i*) of the perpendicular warp line Q (4*i*) becomes larger (α (4*i*)>α (4*g*)) as it gets closer to the rotation direction A side (closer to the rotation center O), the shroud-side blade front edge 4*a*2 and the projecting blade front-edge 4*a*3 warp (incline) more, the more close they are to the rotation direction A side.

Also, since, on plan view, the projecting front-edge end point 4*f* is advanced in the rotation direction A more than the front-edge curved point 4*h* and is located farther away from the rotation center O, and on side view, the projecting front-edge end point 4*f* is advanced in the rotation direction A more than the main-plate-side front-edge vertical portion 40*a*1 (equal to the front-edge curved point 4*h*), a "triangular blade shape" having the projecting front-edge end point 4*f* as an apex and the shroud-side blade front edge 4*a*2 and the projecting blade front edge 4*a*3 (including the main-plate-side front-edge inclined portion 42*a*1) as two sides is formed.

(e) The air pushed by the blade outer face 4*c*, which is the positive pressure side, generates a vertical vortex going toward the blade inner face 4*d*, which is the negative pressure side, draws the flow toward the blade inner face 4*d*, and even if the air-flow resistance changes on the suction side, due to the flow supplied to the blade surface (the blade inner face 4*d* and the blade outer face 4*c*) is a vertical vortex, the air does not separate.

(f) As a result of the above, since equalization of the velocity of air passing between the blades 4 and prevention of separation of air on the blade surface can be achieved, noise reduction can be realized.

(g) Also, on plan view, the angle θ1 formed by the horizontal chord line S1 (See FIG. 6) that connects the front-edge curved point 4*h* and the rear edge curved point 4*j* and the horizontal chord line S3 (See FIG. 8) that connects the projecting front-edge end point 4*f* and the shroud-side rear edge end point 4*b*22 is less than 10° (0°<θ1<0°), and the projecting front-edge end point 4*f* is formed so as to advance in the rotation direction A with respect to the main-plate-side front-edge vertical portion 40*a*1. Thus, a suction region of the blade is reduced, and the suction region is not disturbed. Also, since a downstream transfer length of the vertical vortex, the vortex generated in the vicinity of the curved portion of the main-plate-side front-edge inclined portion 42*a*1 and the shroud-side blade front edge 4*a*2 having the projecting blade front edge 4*a*3 (projecting front-edge end point 4*f*) between them, is not too long, a stable vortex is generated, and since the flow is stable and is not disturbed, noise reduction can be realized.

(Sectional Structure of Blade)

FIG. 13 is a sectional view schematically explaining a sectional structure of the blade. As for the blade 4, in the range on the main plate 2 side of the line that connects the front-edge curved point 4*h* and the rear edge curved point 4*j*, the blade inner face 4*d* is substantially perpendicular to the main plate, while the blade outer face 4*c* is inclined to the rotation center O side as it furthers away from the main plate 2. That is, the blade thickness, which is a distance between the blade inner face 4*d* and the blade outer face 4*c*, becomes smaller (equal to being tapered) as it furthers away from the main plate 2.

This is the same as the distance between the blade outer face 4*c* of the blade 4 and the blade inner face 4*d* of another blade 4 adjacent to the blade becoming larger as it furthers away from the main plate 2, and thus, concentration of flow to the main plate 2 can be avoided and air velocity is equalized, and noise reduction can be realized.

Also, the blade 4 has a hollow structure with which a cavity 4*v* is formed inside opened on the lower face of the main plate 2. Therefore, as compared with the blade 4 having a solid structure, weight reduction can be realized. Also, since the range of the blade 4 close to the main plate 2 is formed in a double structure made of a plate-shaped material having substantially the same thickness as that of the main plate 2 or the shroud 3, the turbo fan 1 can be easily molded integrally by a resin.

(Blade Rear Edge)

FIGS. 13 and 14 explain the blade rear edge schematically, in which FIG. 13 is a side view and FIG. 14 is an extended view obtained by extending an outer peripheral virtual cylinder on a plane.

In FIGS. 13 and 14, the blade rear edge 4*b* is located on the virtual outer peripheral cylinder (equal to the virtual cylinder that connects the main-plate outer periphery 2*b* and the shroud outer periphery 3*b*). The blade rear edge can be roughly divided into the main-plate-side blade rear edge 4*b*1, which is closer to the main plate 2 with less inclination with respect to the main plate 2, and the shroud-side blade rear edge 4*b*2, which is closer to the shroud 3 located more (retreats) in the counter-rotation direction (retreats) as it becomes closer to the shroud 3. The boundary between the two is not particularly distinctive and the positions of the boundary are not limited by it.

In FIG. 14, in the range corresponding to the main-plate-side blade rear edge 4*b*1, an angle formed by the blade outer face 4*c* and the main plate 2 is referred to as an inclination angle β (4*b*1) and an angle formed by the blade inner face 4*c* and the main plate 2 is referred to as an inclination angle δ (4*b*1). At this time, since the inclination angle β (4*b*1) is an obtuse angle and the inclination angle δ (4*b*1) is a sharp angle (β (4*b*1)>90°>δ (4*b*1)), the main-plate-side blade rear edge 4*b*1 has a substantially trapezoidal shape with the side closer to the main plate 2 to be wider.

Also, in the range corresponding to the shroud-side blade rear edge 4*b*2, an angle formed by the blade outer face 4*c* and the shroud 3 is referred to as an inclination angle β (4*b*2) and an angle formed by the blade inner face 4*d* and the shroud 3 is referred to as an inclination angle δ (4*b*2). At this time, since the inclination angle β (4*b*2) is substantially the same as the inclination angle δ (4*b*2), the shroud-side blade rear edge 4*b*2 has a substantially rectangular shape.

Moreover, by approximating the blade outer face 4*c* in the range close to the main plate 2 of the main-plate-side blade rear edge 4*b*1 to a straight line, by approximating the blade outer face 4*c* in the range close to the shroud 3 of the shroud-side blade rear edge 4*b*2 to a straight line, and by referring the intersection of these two straight lines as an "outer-face rear edge curved point 4*kc*", the blade outer face 4*c* is curved with a curving angle ϕ (4*kc*) around the outer-face rear edge curved point 4*kc*.

Similarly, by approximating the blade inner face 4*d* in the range close to the main plate 2 of the main-plate-side blade rear edge 4*b*1 to a straight line, by approximating the blade inner face 4*d* in the range close to the shroud 3 of the shroud-side blade rear edge 4*b*2 to a straight line, and by referring the intersection of these two straight lines as an "inner-face rear edge curved point 4*kd*", the blade inner face 4*d* is curved with a curving angle ϕ (4*kd*) around the inner-face rear edge curved point 4*kd*. At this time, the following relationships are formed:

"$\phi(4kc)=\beta(4b1)+\beta(4b2)$",

"$\phi(4kd)=\delta(4b1)+\delta(4b2)$",

"$180°>\phi(4kc)>\phi(4kd)$".

Moreover, the outer-face rear edge curved point 4*kc* is located at a position advanced into the rotation direction A from the inner-face rear edge curved point 4*kd*.

(Action/Effect in Blade Rear Edge Portion)

(A) In the blade outer face 4*c*, the blade 4 is curved at the outer-face rear edge curved point 4*kc*, and the main-plate-side blade rear edge 4*b*1 is in an upright state with respect to the shroud-side blade rear edge 4*b*2. Therefore, the entire shape retreats in the rotation direction A, and when a part of the flow goes toward the shroud 3 side by the pressure gradient from the main-plate 2 to the shroud 3 side, the pressure of the main plate 2 side is raised with respect to the shroud 3 side. Thus, the flow is further drawn to the shroud 3 side, and even if air-flow resistance fluctuates, a region where separation of air occurs is hardly generated in the shroud-side blade rear edge 4*b*2.

(B) As described above, the main-plate-side blade rear edge 4*b*1 has a substantially trapezoidal shape with the side closer to the main plate 2 wider, the blade outer face 4*c* is substantially perpendicular to the main plate 2, and the blade inner face 4*d* is inclined, and thus, a part of the flow going toward the main plate 2 side where the flow can easily concentrate goes toward directions of the inner-face rear edge curved point 4*kd* and the shroud 3. As a result, a local high-velocity flow no longer occurs in a fan outlet 1*b*, the air-velocity distribution is equalized, and the flow is stabilized against the fluctuation of the air-flow resistance. Thus, noise reduction and resistance against disturbance can be realized, and quality is improved and stabilized.

(C) The shroud-side blade rear edge 4*b*2 is located further in the counter-rotation direction (retreats) as it becomes closer to the shroud 3. That is, in FIG. 8, an angle θ2 formed by a radial line M1 that connects the rotation center O and the rear edge curved point 4*j* (equal to the main-plate-side rear edge end point 4*b*11) and a radial line M3 that connects the rotation center O and the shroud-side rear edge end point 4*b*22 is "5° to 10°".

Therefore, if the angle θ2 is too small, the flow toward the main plate 2 side on the blade outer face 4*c* is concentrated. On the other hand, if the angle θ2 is too large, the flow is drawn to the shroud 3 side excessively causing the air velocity on the shroud 3 side to become high, and the air-velocity distribution is made uneven, thus noise is increased. That is, if the angle θ2 is in the above range (5°<θ2<10°), the air-velocity distribution is equalized, and since there is no particular high-velocity region, noise reduction can be realized.

INDUSTRIAL APPLICABILITY

In the turbo fan according to the present invention, since separation of air flow and turbulent flow (generation of vortex) are suppressed and noise reduction can be realized, the turbo fan can be widely mounted on various devices provided with blower means, including various types of air conditioning apparatus.

REFERENCE SIGNS LIST

1 turbo fan (Embodiment 2), 1*a* fan inlet, 1*b* fan outlet, 2 main plate, 2*a* boss, 2*b* main-plate outer periphery, 3 shroud, 3*b* shroud outer periphery, 4 blade, 4*a* blade front edge, 4*a*1 main-plate-side blade front edge, 4*a*11 main-plate-side front-edge end point, 4*a*12 main-plate-side front-edge warp point, 4*a*13 main-plate-side intermediate warp point, 4*a*2 shroud-side blade front edge, 4*a*3 projecting blade front edge, 4*b* blade rear edge, 4*b*1 main-plate-side blade rear edge, 4*b*11 main-plate-side rear edge end point, 4*b*2 shroud-side blade rear edge, 4*b*22 shroud-side rear edge end point, 4*c* blade outer face, 4*c*1 blade outer face, 4*c*11 blade outer face, 4*c*2 blade outer face, 4*c*3 blade outer face, 4*d* blade inner face, 4*d*1 blade inner face, 4*d*11 blade inner face, 4*d*2 blade inner face, 4*d*3 blade inner face, 4*e* intermediate curved point, 4*e*1 main-plate-side blade intermediate portion, 4*e*2 shroud-side blade intermediate portion, 4*f* projecting front-edge end point, 4*g* shroud-side front-edge end point, 4*h* front-edge curved point, 4*i* position (on shroud-side blade front-edge 4*a*2), 4*j* rear edge curved point, 4*kc* outer-face rear edge curved point, 4*kd* inner-face rear edge curved point, 4*v* cavity, 10 air conditioner main body, 10*a* main-body top plate, 10*b* main-body side plate, 10*c* main-body inlet, 11 decorative panel, 11*a* suction grill, 11*b* panel blow-out port, 12 filter, 13 air-direction vane, 14 bell mouth, 15 fan motor, 16 heat exchanger, 17 room, 18 ceiling face, 19 recess portion, 40*a* main-plate-side front-edge vertical portion, 40*e* main-plate-side intermediate vertical portion, 41*a* main-plate-side front-edge skirt portion, 41*e* main-plate-side intermediate skirt portion, 42*a* main-plate-side front-edge inclined portion, α warp angle, β inclination angle, δ inclination angle, θ angle, θ1 angle, θ2 angle, ϕ curving angle, 100 air conditioning apparatus (Embodiment 1), A rotation direction, M1 radial line, M3 radial line, O rotation center, P1 horizontal warp line (position of front-edge curved point), P11 horizontal warp line (position of main-plate-side front-edge end point), P2 horizontal warp line (position of shroud-side blade front edge), P3 horizontal warp line (position of projecting front-edge end point), Q perpendicular warp line or perpendicular line, R distance, S1 horizontal chord line (position of front-edge curved point), S2 horizontal chord line (position of shroud-side blade front edge), S3 horizontal chord line (position of projecting front-edge end point).

What is claimed is:

1. A turbo fan comprising:

a disk-shaped main plate provided with a rotation center at a center thereof and a projecting boss formed in a vicinity of the rotation center;

a cylindrical shroud arranged opposite to the main plate and provided with a diameter expanded portion configured to have an inner diameter increasing with decrease in distance to the main plate; and a plurality of blades, with one end and the other end being joined to the main plate and the shroud, respectively, wherein each blade includes a blade front edge and a blade rear edge, and the blade front edge of each blade is located closer to the rotation center than the blade rear edge of the blade, and farther in a direction of rotation of the turbo fan than the blade rear edge, wherein a blade outer face, which is a face away from the rotation center of the blade, is formed on a projecting face projecting in a direction away from the rotation center, wherein the blade front edge is divided into a main-plate-side blade front edge close to the main plate, a shroud-side blade front edge close to the shroud, and a projecting blade front edge formed between the main-plate-side blade front edge and the shroud-side blade front edge, wherein in a range, close to the main plate, of the main-plate-side blade front edge, a main-plate-side front-edge skirt portion is formed, wherein in a range of the main-plate-side blade front edge farther away from the main plate than the main-plate-side front-edge skirt portion, a main-plate-side front-edge vertical portion perpendicular to the main plate is formed, wherein in a range farther away from the main plate than the main-plate-side front-edge vertical portion, with respect to the main-plate-side front-edge vertical portion, a main-plate-side front edge inclined portion is formed to have an inclination along which it is increasingly distant from the blade rear edge and increasingly distant from the rotation center, with increase in distance to the main plate, wherein a range closer to the main plate than a projecting front-edge end point of the projecting blade front edge continues from the main-plate-side front edge inclined portion and is increasingly distant from the blade rear edge and increasingly distant from the rotation center, with increase in distance to the main plate, and wherein a range farther away from the main plate than the projecting front-edge end point of the projecting blade front edge continues to the shroud-side blade front edge and is increasingly close to the blade rear edge and increasingly distant from the rotation center with increase in distance to the main plate.

2. The turbo fan of claim 1, wherein the main-plate-side front-edge skirt portion is designed to have an inclination along which it is increasingly distant from the blade rear edge and the rotation center with decrease in distance to the main plate.

3. The turbo fan of claim 2, wherein the blade rear edge is divided into a main-plate-side blade rear edge close to the main plate and a shroud-side blade rear edge close to the shroud, the main-plate-side blade rear edge is substantially perpendicular to the main plate, and the shroud-side blade rear edge is designed to have an inclination along which it is increasingly distant from the blade front edge with increase in distance to the main plate.

4. The turbo fan of claim 3, wherein on plan view, an angle is formed by a radial line that connects a main-plate-side rear edge end point, which is an intersection between the main-plate-side blade rear edge and the main plate, and the rotation center, and a radial line that connects a shroud-side rear edge end point, which is an intersection between the shroud-side blade rear edge and the shroud, and the rotation center, is 5° to 10°, and the radial line that connects the main-plate-side rear edge end point and the rotation center is located at a position farther in a rotation direction than the radial line that connects the shroud-side rear edge end point and the rotation center.

5. The turbo fan of claim 1, wherein a warp angle is formed in a range away from the main plate, the warp angle being formed by a perpendicular warp line, which is a center line between a blade outer face and a blade inner face formed by a plane perpendicular to the main plate, and a perpendicular line perpendicular to the main plate, and the warp angle is configured to gradually increase with increase in distance to the blade rear edge.

6. The turbo fan of claim 1, wherein an angle formed by a horizontal chord line of the blade in the main-plate-side front-edge vertical portion and a horizontal chord line of the blade at the projecting front-edge end point is 0° to 10°, and in an outer periphery of the main plate, the horizontal chord line of the blade in the main-plate-side front-edge vertical portion is located farther in a direction of rotation of the turbo fan than the horizontal chord line of the blade at the projecting front-edge end point.

7. The turbo fan of claim 1, wherein the blade has a hollow structure with a cavity with an opening penetrating through the main plate, and a distance between the blade outer face and the blade inner face is configured to gradually decrease with increase in distance to the main plate.

8. The turbo fan of claim 1, wherein a blade interval between a blade outer face of the one blade and a blade inner face of the other blade adjacent to the one blade in a range close to the main plate of the blade rear edge is smaller than that in a range away from the main plate of the blade rear edge.

9. An air conditioning apparatus comprising:

a main body in which an inlet and an outlet of air are formed on one face thereof;

the turbo fan of claim 1, communicating with the inlet and arranged in the main body; and air conditioning unit arranged between the turbo fan and the outlet.

* * * * *